US006695728B1

(12) United States Patent
Eddins

(10) Patent No.: US 6,695,728 B1
(45) Date of Patent: Feb. 24, 2004

(54) THROWING TOY WITH DISTANCE COUNTER

(75) Inventor: Fred Daniel Eddins, Mapleville, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 10/361,401

(22) Filed: Feb. 10, 2003

(51) Int. Cl.[7] ..... A63B 43/00
(52) U.S. Cl. ..... 473/613
(58) Field of Search ..... 473/570, 613, 473/575, 576, 585, 586

(56) References Cited

U.S. PATENT DOCUMENTS 4,775,948 A 10/1988 Dial et al.
5,072,938 A * 12/1991 Shin ..... 473/613
5,526,326 A 6/1996 Fekete et al.
5,761,096 A 6/1998 Zakutin
5,779,576 A 7/1998 Smith, III et al.
5,807,198 A * 9/1998 Grimm ..... 473/613
5,912,864 A 6/1999 Maurer
6,042,494 A * 3/2000 Rappaport et al. ..... 473/613

* cited by examiner

*Primary Examiner*—Steven Wong
(74) *Attorney, Agent, or Firm*—Marshall, Gerstein & Borun LLP

(57) ABSTRACT

A throwing toy having a rotational counter includes a football-shaped body and a tail assembly connected to the football-shaped body. The tail assembly includes a cylindrical body rotationally fixed to the football-shaped body, a rotational counter mounted within the cylindrical body, with the rotational counter having a first part rotationally fixed to the cylindrical body and a second part rotational with respect to the first part, the rotational counter arranged to provide visual indicia indicative of the number of rotations of the first part relative to the second part, and an elongate rod having a central axis. A first end of the elongate rod is operatively fixed to the second part of the rotational counter, and at least one tail fin is mounted to a second end of the elongate rod, the tail fin causing the elongate rod and the second part of the rotational counter to rotate relative to the first part of the rotational counter when the throwing toy is thrown through the air.

26 Claims, 6 Drawing Sheets

THROWING TOY WITH DISTANCE COUNTER

BACKGROUND OF THE INVENTION

The present invention is directed to a throwing toy having a football-shaped body and a rotating tail that extends outwardly from the football-shaped body.

Throwing toys having football-shaped bodies and rearwardly extending tail sections have been commercially marketed more than one year prior to the filing date of this patent. For example, a throwing toy marketed under the trademark Vortex® had a football-shaped body and a tail section fixed to the football-shaped body that extends rearwardly from the football-shaped body. The tail section included three tail fins, each of which was positioned radially about the tail section.

U.S. Pat. No. 5,807,198 to Grimm discloses a tossable game ball having a football-shaped body and a tail section that is mounted to and extends rearwardly from the football-shaped body. The tail section has three tail fins. The tail section is fixed to the football-shaped body so that, when the game ball is thrown, the football-shaped body and the tail section rotate together at the same rate of rotation.

A throwing toy similar to that described in U.S. Pat. No. 6,010,419 to Rappaport, et al. was marketed under the trademark Vortex® Mega Spin™ football by OddzOn, Inc. more than one year prior to the filing date of this patent. The throwing toy disclosed in the Rappaport, et al. patent has a football-shaped body and a tail section coupled to the football-shaped body. The tail section is rotatable relative to the football-shaped body so that, when the toy is thrown, the football-shaped body rotates while the tail section does not rotate.

SUMMARY OF THE INVENTION

In one aspect, a throwing toy having a rotational counter includes a football-shaped body and a tail assembly connected to the football-shaped body. The tail assembly includes a cylindrical body rotationally fixed to the football-shaped body, a rotational counter mounted within the cylindrical body, with the rotational counter having a first part rotationally fixed to the cylindrical body and a second part rotational with respect to the first part, the rotational counter arranged to provide visual indicia indicative of the number of rotations of the first part relative to the second part, and an elongate rod having a central axis. A first end of the elongate rod is operatively fixed to the second part of the rotational counter, and at least one tail fin is mounted to a second end of the elongate rod, the tail fin causing the elongate rod and the second part of the rotational counter to rotate relative to the first part of the rotational counter when the throwing toy is thrown through the air.

In further accordance with an aspect, the cylindrical body may include a forward part and a rearward part, and the rearward part may includes an aperture with the elongate rod extending through the aperture. A window may be provided wherein the visual indicia is viewable through the window, and the rearward part and the forward part may be suitably joined along an interface with the counter received within a seat formed within the cylindrical body. The rotational counter may include a reset button, and the forward part of the elongate rod may be secured within an aperture in the second part of the rotational counter.

A plurality of tail fins may be mounted to the second end of the elongate rod, and each of the tail fins may include a trailing edge having an angled surface. The cylindrical body may be provided with a cup-shaped forward end sized to receive a trailing end of the football-shaped body, and the elongate rod may have a circular cross-section.

In another aspect, a throwing toy comprises a football-shaped body, and a tail assembly connected to the football-shaped body and having a tail section mounted for rotation relative to the football-shaped body. The tail assembly comprises a cylindrical body rotationally fixed to the football-shaped body, a rotational counter mounted within the cylindrical body, the rotational counter having a first part rotationally fixed to the cylindrical body and a second part rotational with respect to the first part, the rotational counter arranged to provide visual indicia indicative of the number of rotations of the first part relative to the second part, an elongate rod having a central axis, a first end of the elongate rod operatively fixed to the second part of the rotational counter, and a tail fin assembly mounted to a second end of the elongate rod. The tail fin assembly causes the elongate rod and the second part of the rotational counter to rotate relative to the first part of the rotational counter when the throwing toy is thrown through the air.

In another aspect, a throwing toy comprises a football-shaped body and a tail assembly connected to the football-shaped body and having a tail section mounted for rotation relative to the football-shaped body. The tail assembly comprises a cylindrical body rotationally fixed to the football-shaped body, a rotational counter mounted within the cylindrical body, the rotational counter having a first part rotationally fixed to the cylindrical body and a second part rotational with respect to the first part, the rotational counter arranged to provide visual indicia indicative of the number of rotations of the first part relative to the second part, an elongate rod having a central axis, a first end of the elongate rod operatively fixed to the second part of the rotational counter, and a plurality of tail fins formed on a rearward portion of the elongate rod, the tail fins sized and shaped to cause the elongate rod and the second part of the rotational counter to rotate relative to the first part of the rotational counter when the throwing toy is thrown through the air.

The features and advantages of the present invention will be apparent to those of ordinary skill in the art in view of the detailed description of the preferred embodiment, which is made with reference to the drawings, a brief description of which is provided below.

DETAILED DESCRIPTION OF VARIOUS EMBODIMENTS

Figure 1:
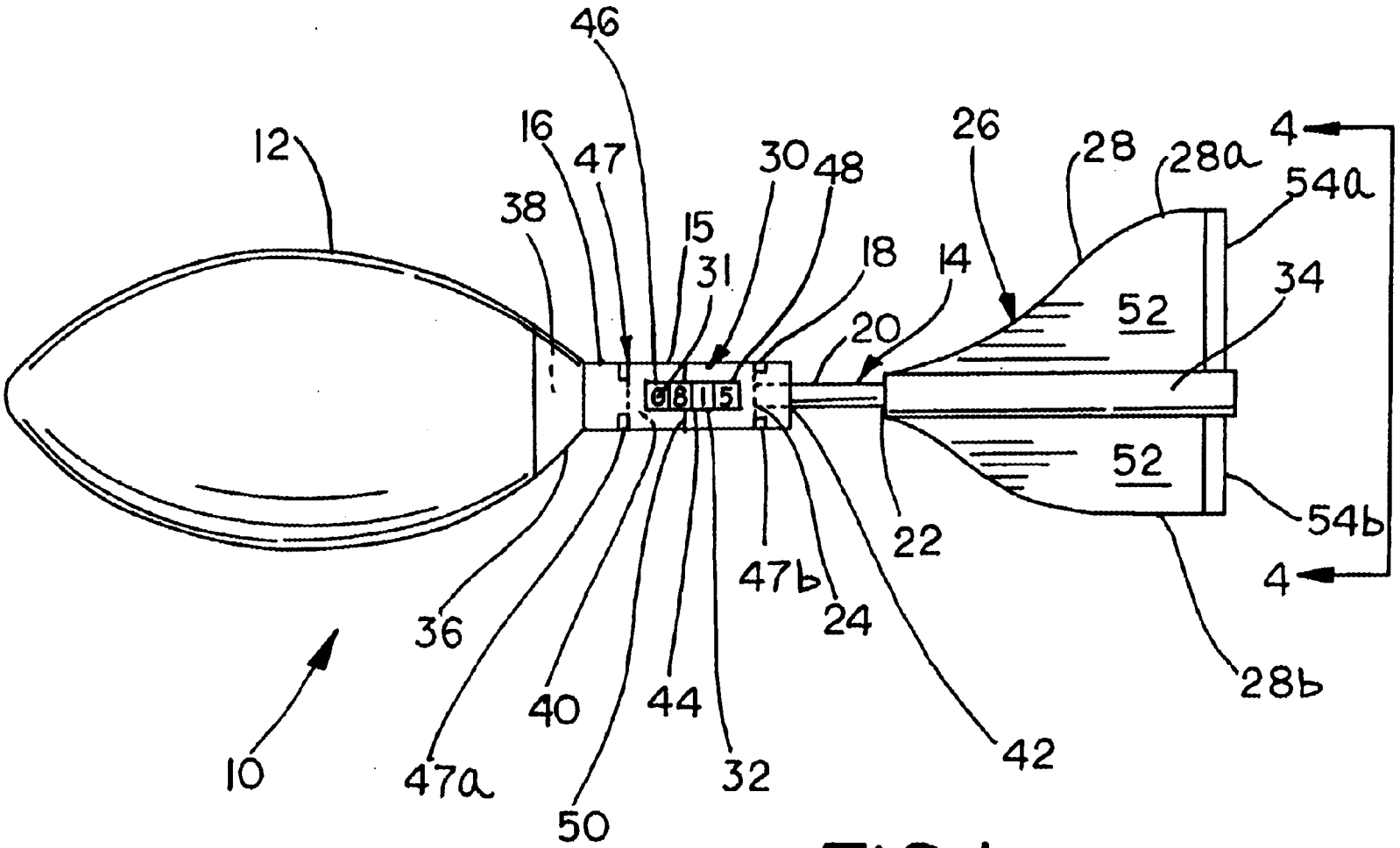
FIG. 1 is a side view of an embodiment of a throwing toy in accordance with the invention.

FIG. 1 is a side view of an embodiment of a throwing toy 10 in accordance with the invention. Referring to FIG. 1, the throwing toy 10 may be provided with a football-shaped body 12 and a tail assembly 14 that is coupled to the football-shaped body 12. The football-shaped body 12 may be provided with a length of about six inches to allow it to be gripped by one's hand prior to throwing the toy 10.

Figure 3:
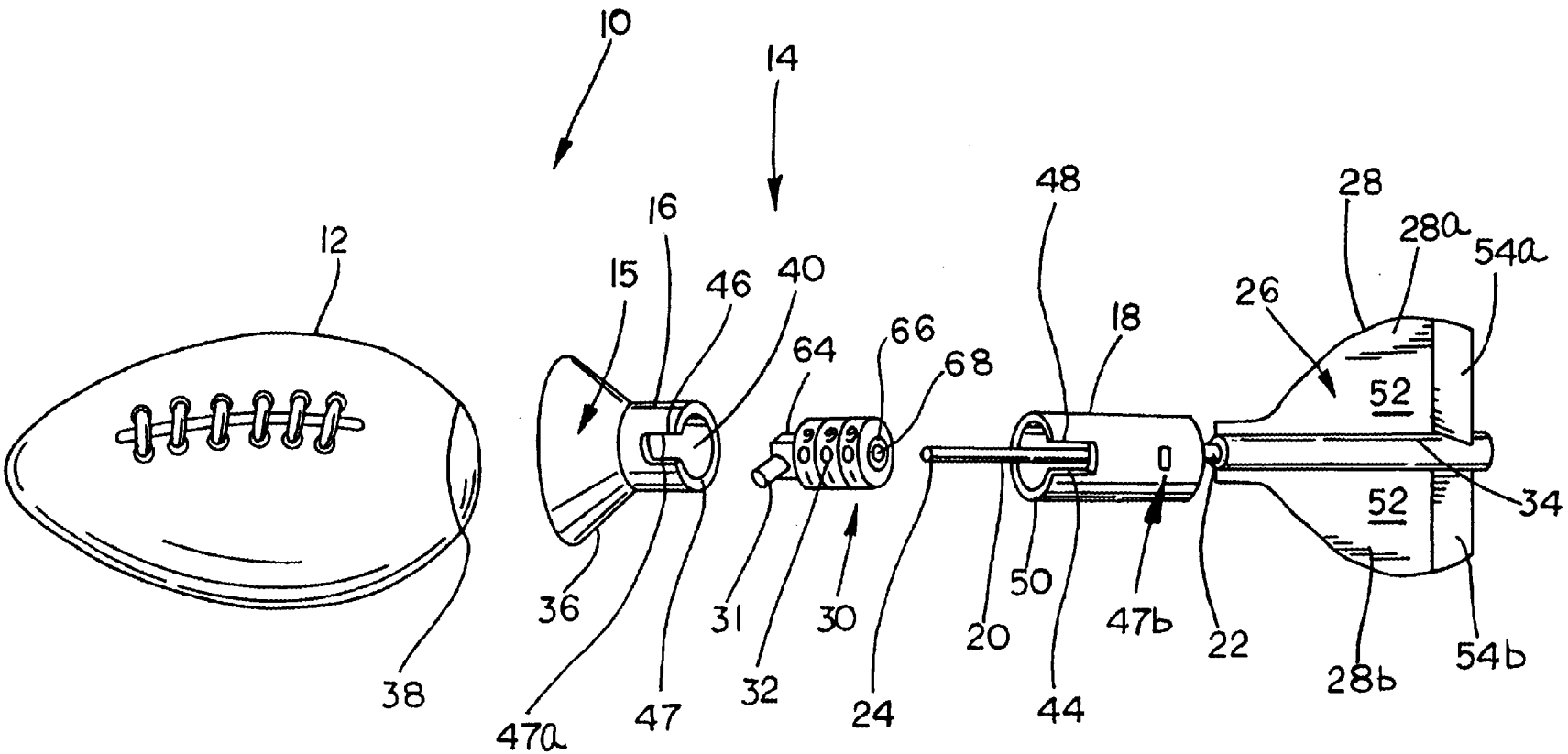
FIG. 3 is an exploded view, partly in perspective, of the throwing toy in FIG. 1.

Referring to FIGS. 1 and 3, the tail assembly 14 may include a cylindrical body 15 formed of a forward tubular section 16 and rearward tubular section 18. The tail assembly 14 may also include an elongate rod 20 having ends 22, 24. A rear tail section 26 is preferably mounted to the end 24, with the rear tail section 26 preferably including one or more fins 28. A rotational counter 30 is disposed within the cylindrical body 15, with the rotational counter 30 including indicia 32, such as numbers or other suitable indicia. The end 22 of the elongate rod 20 is connected to the rotational counter 30 as will be explained in greater detail below.

The tail section 30 may include a plurality of tail fins 28, which may be triangular in shape, and which may be connected to a central part 34 of the tail section 30 at points radially spaced about the central part 34. For example, referring to FIG. 4, if three tail fins 28*a*, 28*b*, 28*c* are utilized, the tail fins 28*a*, 28*b*, 28*c* may be spaced radially 120° apart. The tail fins 28*a*, 28*b*, 28*c* may be connected to the tube 22, such as by adhesive, or the tail fins 28*a*, 28*b*, 28*c* may be integrally formed with the central part 34 of the tail section 26. Still other forms of construction may be contemplated.

Referring still to FIGS. 1 and 3, the forward tubular section 16 and the rearward tubular section 18 may each comprise a cylindrical bearing tube, such that together the sections 16 and 18 define a cylindrical cavity 40. The cylindrical cavity is suitably sized to receive the rotational counter 30, and may include suitable stops and/or supports (not shown) to enable the rotational counter 30 to be suitably secured within the cylindrical body 15. The rearward tubular section 18 may be provided with a central bore 42 (FIG. 1) through which the elongate rod 20 passes, and the diameter of the central bore 42 may be selected so as to allow the elongate rod 20 to freely rotate relative to the rearward tubular section 18 and the cylindrical body 15.

The body 15 is preferably provided with a window 44, with the indicia 32 on the counter 30 preferably being viewable through the window 44. In the disclosed example, the window 44 is formed by cooperating notches 46 and 48, with the notch 46 formed in the forward tubular section 16 and the notch 48 formed in the rearward tubular section 18. Accordingly, when the sections 16 and 18 are joined along an interface 50 as shown in FIG. 1, the notches 46, 48 form the window 44. The interface 50 may take a variety of forms, with the interface 50 formed by adhesively mating the edges of the sections 16 and 18. Alternatively, the section 16 may be formed of a slightly greater diameter so as to receive the section 18 therein, or vice-versa. Other suitable forms for joining the sections 16 and 18 may be used.

Figure 4:
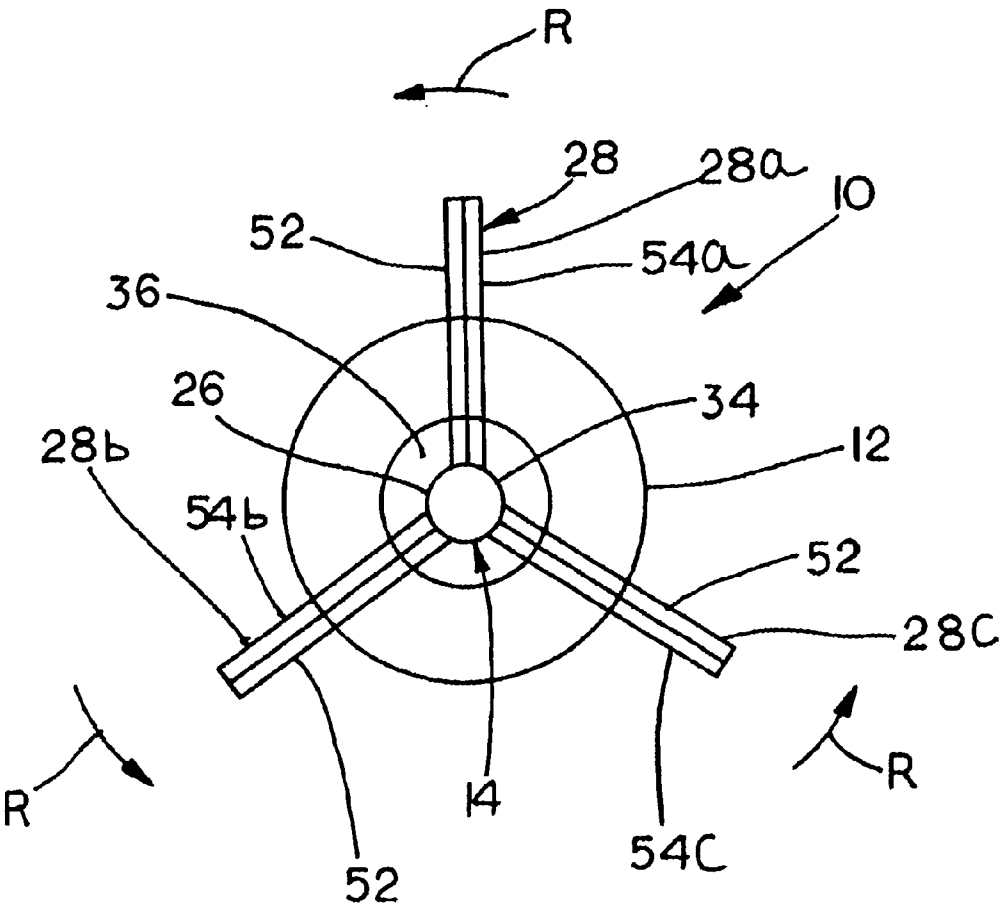
FIG. 4 is an end view taken along line 4—4 of FIG. 1.

Referring to FIG. 4, the tail fins 28*a*, 28*b*, 28*c* are spaced radially about the central part 34 of the tail section 26. Each of the tail fins 28*a*, 28*b*, 28*c* may form a planar or substantially planar wing surface 52. Each of the tail fins 28*a*, 28*b*, and 28*c* also may be provided with an angled aileron or wing 54*a*, 54*b*, 54*c*, respectively, such that the wings 54*a*, 54*b*, 54*c* may, in the disclosed example, assist in imparting rotation R to the tail section 26 and hence the rod 20 relative to the football-shaped body 12 when the throwing toy 10 is proceeding through the air along a path of trajectory.

Figure 2:
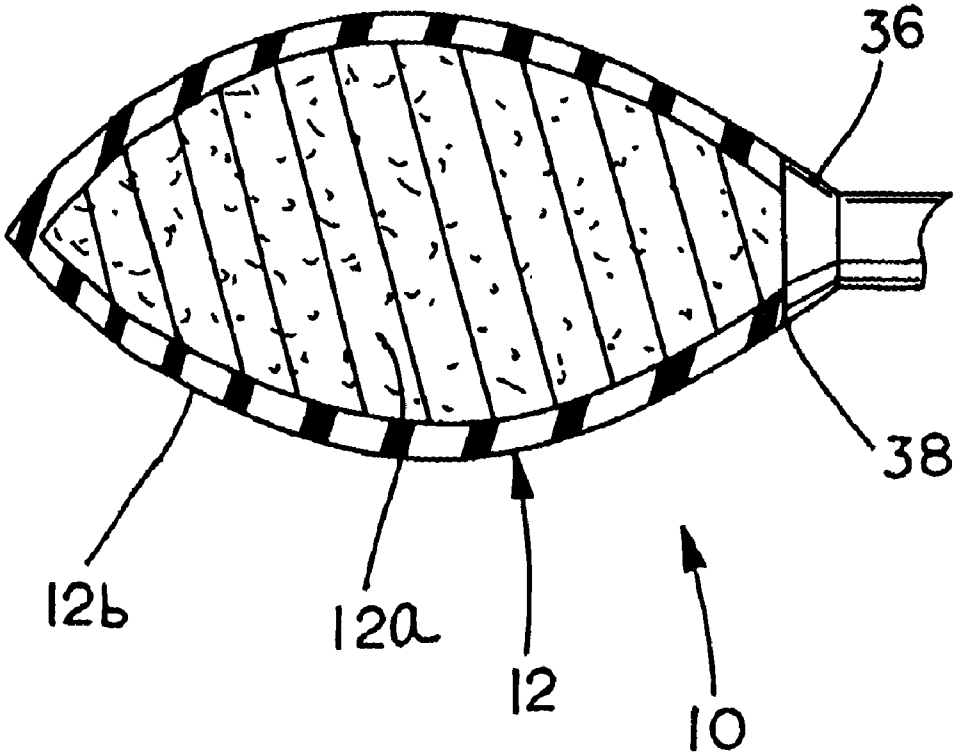
FIG. 2 a fragmentary cross-sectional view showing the football shaped body in cross-section.

Referring to FIG. 2, the football-shaped body 12 may be provided with an inner core 12*a*, which may comprise a foam-type material, and an outer cover 12*b*, which may comprise a rubber-like material that resists abrasion when the throwing toy 10 lands on the ground and that allows the football-shaped body 12 to be easily gripped for throwing purposes. U.S. Pat. Nos. 5,807,198 and 6,010,419, which are incorporated herein by reference, disclose materials that could be utilized for the football-shaped body 12. The particular materials that are used in the football-shaped body 12 are not considered important to the invention. The outer layer 12*b* may be formed over the inner core 12*a*. Although one method of construction is described, other methods could be utilized.

The forward tubular section 16 may include a cup-shaped end 36, which is preferably sized in complementary fashion to receive the rearward portion 38 of the football-shaped body 12, such that the forward tubular section 16 and the football-shaped body 12 may be suitably joined by an adhesive.

As shown in FIG. 3, the rotational counter 30, which may be conventional and which may be obtained from a plurality of commercial sources, includes a first part 64 and a second part 66. As would be known, relative rotation between the first and second parts 64, 66 causes the visible indicia 32 (in the preferred form numerical indicia) to change in increments indicative of complete or partial relative rotations between the first and second parts 64, 66. As shown in FIG. 3, the first part 64 is arranged to be rotationally fixed to the section 16 of the cylindrical body 15, and hence the first part 64 will be rotationally fixed relative to the body 12. The second part 66 is arranged to be rotationally fixed to the elongate rod 20, and hence the second part will be rotationally fixed relative to the tail section 26. The end 24 of the rod 20 may be suitably secured to a receiving aperture 68 in the second part 66. For example, the end 24 maybe secured to the receiving aperture by gluing or bonding, by a press fit or a swaged connection, by a friction or interference fit which may include a knurled cylindrical connection, or by any other suitable mechanical connection. Additionally, one of skill in the art will appreciate that suitable spacers, washer, etc., may be provided as needed in order to reduce friction at appropriate points in the tail assembly 14.

Referring again to FIGS. 1, 3 and 4, the wings 54*a–c* of the tail fins 28 on the tail section 26 may each be mounted on their respective fins 28*a–c* at an angle so that when the throwing toy 10 is thrown through the air, the impact of the air against the tail fins 28 will cause the tail section 26 to rotate in the direction R (viewing FIG. 4) The wings may of course be oriented at varying angles relative to the fins 28 so as to increase or decrease the rate of rotation, or to change the direction of rotation of the tail section 26 relative to the body 12.

The throwing toy 10 may be assembled by forming the tail assembly 14 and securing the football-shaped body 12 to the tail assembly 14 using an appropriate adhesive. Alternatively, if formed according to the example of FIG. 5, the throwing toy 10 may be assembled by forming the tail assembly 14 and then forming the football-shaped body 12 about the tail assembly 14.

The tail assembly 14 may be formed by placing the rotational counter 30 in the section 16 with a reset button 31 for the counter 30 engaged in the notch 46. A seat 47 may be formed in the cylindrical body 15, such as by cooperating protrusions 47*a* and 47*b* in the sections 16, 18, respectively (FIG. 1). The end 24 of the rod 20 is placed through the aperture 42 in the section 18, and then the end 24 of the rod 20 is suitably secured to the second part 66 of the counter 30 as outlined above. The section 18 is then suitably secured to the section 16, such that the counter 30 is disposed in the cavity 40, with the indicia 32 visible through the window 44.

A coating of adhesive may be applied to appropriate surfaces on the sections 16 and 18, and adhesive may also be applied in order to suitably secure the first part 64 of the counter 30 to the section 16, with care being taken not to inadvertently glue the moveable indicia or to otherwise interrupt the relative rotation between the first and second parts 64 and 66 of the counter 30. When the adhesive dries, the cylindrical body 15 will be fixed to the football-shaped body 12, and the tail section 26 will be freely rotatable with respect to the football-shaped body 12.

Figure 5:
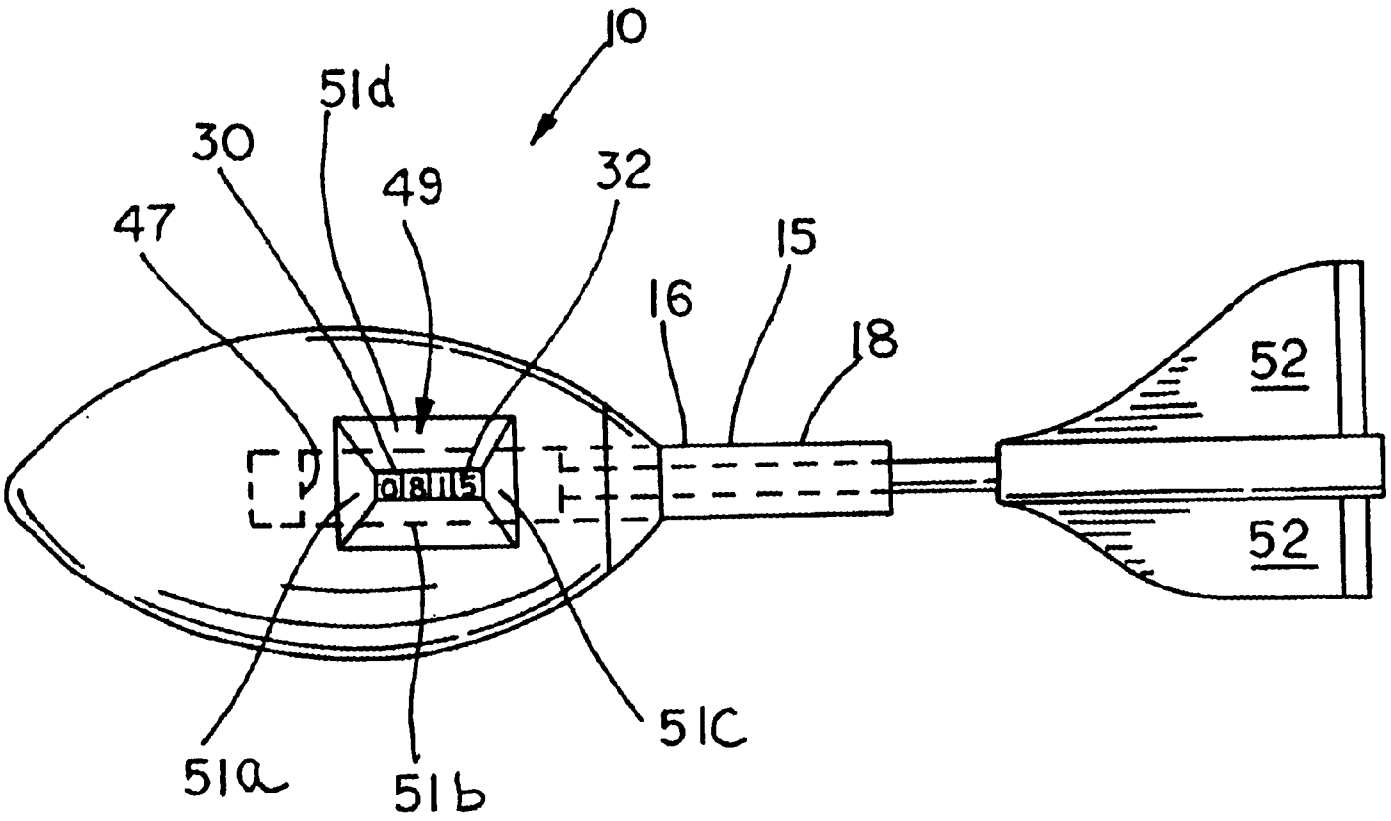
FIG. 5 is a side view of an alternate embodiment of a throwing toy similar to the throwing toy of FIG. 1 but illustrating the rotational counter disposed within the football-shaped body.

FIG. 5 illustrates another exemplary form for the throwing toy 10 in which at least a portion of the cylindrical body 15 and/or the forward section 16 extend forwardly into the football-shaped body 12. Unless specifically mentioned herein, the remaining components of the throwing toy 10 may be the same or substantially similar to those components discussed in detail with respect to the first disclosed example. The rotational counter 30 is disposed forwardly relative to the position shown in FIGS. 1 and 3 and, in the disclosed example, is shown inside the football-shaped body 12, which construction may offer additional protection for the rotational counter 30. The seat 47 may be appropriately located within the cylindrical body 15 so as to conveniently place the rotational counter 30 forward enough to a desired position. The section 18 of the cylindrical body 15 may be sized as necessary, and the length of the elongate rod 20 may be lengthened as necessary so as to extend forwardly far enough into the football-shaped body 12 to engage the rotational counter 30 in a manner substantially similar to that discussed above with respect to the first disclosed example. Preferably, the football-shaped body 12 is provided with a recessed window 49, which may include a plurality of angled walls 51*a*, 51*b*, 51*c* and 51*d* which may generally converge toward the rotational counter 30 so as to reveal the indicia 32.

Figure 6:
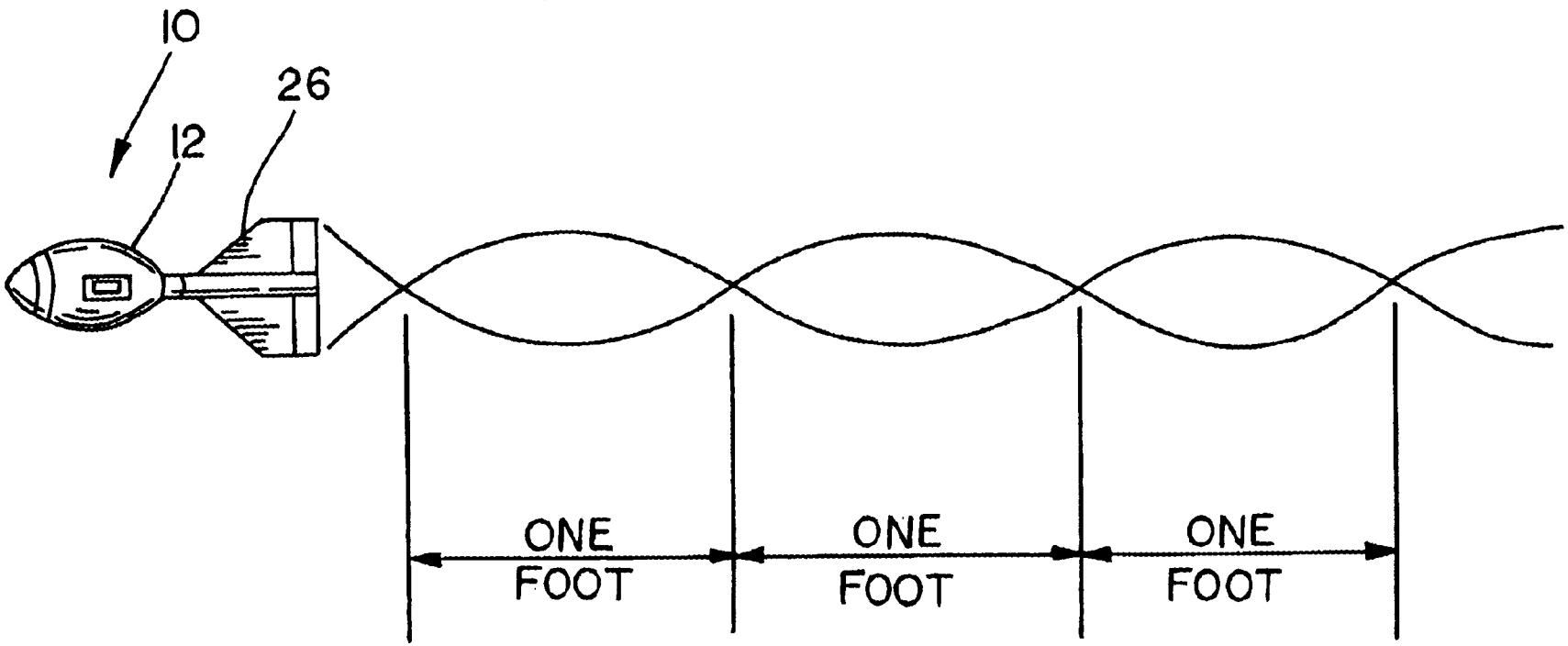
FIG. 6 is a side elevational view of a throwing toy according to any of the preceding embodiments shown traveling through the air along a trajectory and illustrating one possible manner of correlating the distance traveled to the number of rotations of the tail section.

Referring now to FIG. 6, in accordance with the disclosed example(s), the size and angle of the wings 54*a–c* may be adjusted. It will be understood that, as an alternative, the tail fins 28*a–c* may be angled. As the size and/or angle of the wings 54*a–c*, respectively, are increased, the tail section 26 will be made to rotate at a rotational rate that is greater than the rotational rate of the football-shaped body 12. After the throwing toy 10 has been thrown along a trajectory from a starting point to an end point, a user may then conveniently convert the number of rotations indicated by the counter 30 into a distance measurement, either by using the number of rotations as a basis for comparison between successive throws or by comparing the number of rotations to an actual distance measured between the starting point and the end point. The angle of the wings 54*a*–54*c* may be pre-set at a predetermined angle such that the tail section 26 undergoes a single revolution for a predetermined distance. For example, the angle of the wings 54*a*–54*c* may be pre-set so that the tail section 26 rotates a single revolution as the throwing toy travels three (3) feet, such that the rotational counter indicates the distance traveled in yards. The precise angle required would depend on the sizes of the various components, and would be within the skill of those familiar with the art using available scientific principles.

In use, the throwing toy 10 is gripped by placing one's hand on the football-shaped body 12, and the toy 10 is thrown through the air in the same manner that a football would be thrown. Preferably, upon release of the throwing toy 10, the football-shaped body 12 may rotate little or not at all, as the tail section 26 rotates more readily (i.e., the tail section 26 has a substantially lower rotational moment of inertia). The football-shaped body 12 and the cylindrical body 15 are fixed relative to each other and thus tend not to rotate as the tail section 26 rotates. In any event, as the toy 10 travels through the air, the force of the air on the tail fins causes the tail section 26 to rotate relative to the body 12, as described above.

It should be appreciated that numerous changes could be made while still utilizing the invention. For example, various features, such as the wings 54*a–c* could be omitted, and the tail section 26 could be modified, such as by angling the fins 28*a–c* with respect to an axis of the central section 34. Also, instead of providing substantially planar tail fins, non-planar tail fins could be provided to cause the tail section 26 to rotate. The construction of the football-shaped body 12 and the tail assembly 14 could be changed, and the manner in which the tail assembly 14 is mounted to the football-shaped body 12 could be changed. Other details of construction could be utilized, such as those disclosed in U.S. Pat. Nos. 5,807,198 and 6,010,419, which are incorporated by reference herein.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A throwing toy, comprising:

a football-shaped body; and a tail assembly connected to the football-shaped body, the tail assembly comprising:

a cylindrical body rotationally fixed to the football-shaped body;

a rotational counter mounted within the cylindrical body, the rotational counter having a first part rotationally fixed to the cylindrical body and a second part rotational with respect to the first part, the rotational counter arranged to provide visual indicia indicative of the number of rotations of the first part relative to the second part;

an elongate rod having a central axis, a first end of the elongate rod operatively fixed to the second part of the rotational counter; and at least one tail fin mounted to a second end of the elongate rod, the tail fin causing the elongate rod and the second part of the rotational counter to rotate relative to the first part of the rotational counter when the throwing toy is thrown through the air.

2. The throwing toy of claim 1, wherein the cylindrical body includes a forward part and a rearward part.

3. The throwing toy of claim 2, wherein the rearward part includes an aperture, and wherein the elongate rod extends through the aperture.

4. The throwing toy of claim 1, wherein the cylindrical body includes a window, and wherein the visual indicia is viewable through the window.

5. The throwing toy of claim 2, wherein the rearward part and the forward part are joined along an interface.

6. The throwing toy of claim 1, wherein the rotational counter includes a reset button.

7. The throwing toy of claim 1, wherein the forward part of the elongate rod is secured within an aperture in the second part of the rotational counter.

8. The throwing toy of claim 1, including a plurality of tail fins mounted to the second end of the elongate rod.

9. The throwing toy of claim 8, wherein each of the tail fins includes a trailing edge having an angled surface.

10. The throwing toy of claim 1, wherein the cylindrical body includes a cup-shaped forward end sized to receive a trailing end of the football-shaped body.

11. The throwing toy of claim 1, wherein the elongate rod has a circular cross-section.

12. The throwing toy of claim 1, wherein the cylindrical body defines an internal cavity, and wherein the rotational counter is cylindrical and sized for insertion into the cylindrical cavity.

13. The throwing toy of claim 1, wherein the tail fin is sized and shaped so that in response to throwing the throwing toy the football-shaped body rotates at a first rate and the elongate rod rotates at a second rate.

14. The throwing toy of claim 13, wherein the second rate is greater than the first rate.

15. A throwing toy, comprising:

a football-shaped body; and a tail assembly connected to the football-shaped body and having a tail section mounted for rotation relative to the football-shaped body, the tail assembly comprising:

a cylindrical body rotationally fixed to the football-shaped body;

a rotational counter mounted within the cylindrical body, the rotational counter having a first part rotationally fixed to the cylindrical body and a second part rotational with respect to the first part, the rotational counter arranged to provide visual indicia indicative of the number of rotations of the first part relative to the second part;

an elongate rod having a central axis, a first end of the elongate rod operatively fixed to the second part of the rotational counter; and a tail fin assembly mounted to a second end of the elongate rod, the tail fin assembly causing the elongate rod and the second part of the rotational counter to rotate relative to the first part of the rotational counter when the throwing toy is thrown through the air.

16. The throwing toy of claim 15, wherein the cylindrical body includes a forward part and a rearward part, at least one of the forward part and the rearward part forming a cavity sized to receive the rotational counter.

17. The throwing toy of claim 15, wherein the rotational counter includes a first part rotationally fixed to the football-shaped body and a second part rotationally fixed to the tail section.

18. The throwing toy of claim 16, wherein the rotational counter is a mechanical counter.

19. The throwing toy of claim 15, wherein the cylindrical body includes a window, the visual indicia viewable through the window, and wherein the rearward part and the forward part are joined along an interface.

20. The throwing toy of claim 16, wherein the forward part of the elongate rod is secured within an aperture in the second part of the rotational counter.

21. The throwing toy of claim 15, wherein the tail fin assembly includes a plurality of tail fins extending radially from a central section.

22. The throwing toy of claim 21, wherein each of the tail fins includes a trailing edge having an angled wing.

23. The throwing toy of claim 15, wherein the cylindrical body includes a cup-shaped forward end sized to receive a trailing end of the football-shaped body.

24. The throwing toy of claim 15, wherein the elongate rod has a circular cross-section, and wherein the cylindrical body defines an internal seat sized to receive the rotational counter.

25. The throwing toy of claim 15, wherein the tail fin assembly is sized so that in response to throwing the throwing toy the football-shaped body rotates at a first rate and the elongate rod rotates at a second rate greater than the first rate.

26. A throwing toy, comprising:

a football-shaped body; and a tail assembly connected to the football-shaped body and having a tail section mounted for rotation relative to the football-shaped body, the tail assembly comprising:

a cylindrical body rotationally fixed to the football-shaped body;

a rotational counter mounted within the cylindrical body, the rotational counter having a first part rotationally fixed to the cylindrical body and a second part rotational with respect to the first part, the rotational counter arranged to provide visual indicia indicative of the number of rotations of the first part relative to the second part;

an elongate rod having a central axis, a first end of the elongate rod operatively fixed to the second part of the rotational counter; and a plurality of tail fins formed on a rearward portion of the elongate rod, the tail fins sized and shaped to cause the elongate rod and the second part of the rotational counter to rotate relative to the first part of the rotational counter when the throwing toy is thrown through the air.

* * * * *